United States Patent [19]

Bagnall-Wild et al.

[11] 4,418,361

[45] Nov. 29, 1983

[54] TRACKING LINK

[75] Inventors: Ralph H. Bagnall-Wild, Helensburgh; Gordon R. Smith, Torrance; John H. Stewart; David S. Ritchie, both of Glasgow, all of Scotland

[73] Assignee: Barr & Stroud Limited, Glasgow, Scotland

[21] Appl. No.: 373,734

[22] Filed: Apr. 30, 1982

[30] Foreign Application Priority Data

May 15, 1981 [GB] United Kingdom ..... 8114998

[51] Int. Cl.[3] ..... H04N 7/18

[52] U.S. Cl. ..... 358/125; 89/41 TV

[58] Field of Search ..... 33/237; 358/125; 89/41 E, 41 CE, 41 LG, 41 L, 41 MG, 41 T, 41 TV

[56] References Cited

U.S. PATENT DOCUMENTS 3,415,157 12/1968 Marchisio et al. ..... 89/41 E

*Primary Examiner*—Joseph A. Orsino, Jr.

*Attorney, Agent, or Firm*—Mason, Fenwick & Lawrence

[57] ABSTRACT

In a system (10) comprising a trunnion-mounted aiming device (11) and a trunnion-mounted sighting device (14) interconnected by a tracking link (13) and having an associated visual display (16) providing an image of the field of view containing the sight line (15) of the sighting device (14) there is provided a means of accurately positioning an aiming mark designating the pointing direction (12) of the aimed device (11) in the visual display (16). This positioning arrangement is provided by an elevation sensor (18) associated with the aimed device (11), an elevation sensor (19) associated with the sighting device (14), an electronic indicator mark generator (28) and an electronic processor (20), the latter being operable according to the measurements from the sensors (18,19) to deflect the mark generated by the generator (28) so as to compensate in the elevation axis for backlash and inertia of the link (13) and in the traverse axis for lack of parallelism of the trunnion mountings of the devices (11,14). The indicator mark may be generated by a CRT (28,40) in relation to which the processor (20) controls the X and Y drive circuits. Alternatively the processor (20) may generate video bright-up pulses in the raster scan of a scanned raster device forming part of the visual display (16).

5 Claims, 4 Drawing Figures

TRACKING LINK

Many weapon systems involve the use of a ganged aimed device and a sighting device, the latter being used to provide an image of the scene observed in the pointing direction of the aimed device. The aimed device may be, for example, a gun or a rangefinder or a second sighting device. The pointing direction of the aimed device may be indicated in the sighting device by a fixed indicator mark on the image scene. This indicator mark may be used for directing the aimed device at a target by an operator aligning the indicator mark to the target image as viewed in the sighting device.

The accuracy with which the aimed device can be directed in this way is dependent on the accuracy of the predetermined correspondence between the indicator mark and the actual pointing direction of the aimed device.

Physical constraints may require the sighting device to be mounted separately from the aimed device. However, it is customary to mount both devices on a common traversing plane; correspondence in elevation being achieved through a form of mechanical and/or electrical arrangement constituting a tracking link. Differences in the actual pointing direction of the aimed device and the indicator mark of the sighting device may arise because the tracking link for linking them in elevation is inaccurate and errors are created due to backlash bearing friction and inertia, or due to lack of parallelism of the trunnions of the devices, or because one device is stabilised against motion of the common traversing plane, and the other unstabilised.

It is an object of the present invention to provide a means of accurately positioning an aiming mark on the image scene of a sighting device to indicate the pointing direction of an aimed device.

According to the present invention there is provided a system comprising:

a trunnion-mounted aimed device having a pointing direction, a trunnion-mounted sighting device having a line of sight, a visual display providing an image of the field of view containing said line of sight, drive means connected to said aimed device for altering the elevation of said pointing direction, a tracking link interconnecting the aimed device and the sighting device to provide approximate correspondence in elevation of said pointing direction and said line of sight, a first elevation sensor associated with the aimed device for accurately measuring the elevation thereof with respect to a datum, a second elevation sensor associated with the sighting device for accurately measuring the elevation thereof with respect to said datum, wherein said visual display comprises electronic means for generating an indicator mark designating the pointing direction and an electronic processor is provided operable according to the sensor measurements to deflect the electronically generated indicator mark on said visual display accurately to designate the pointing direction of the aimed device so as to compensate in the elevation axis for backlash and inertia of said tracking link and in the traverse axis for lack of parallelism of the trunnions.

The sighting device may be an optical sight, thermal imager, T.V. or image intensifier and the aimed device may be a gun, a laser rangefinder or another sighting device.

Embodiments of the present invention will now be described by way of example, with reference to the accompanying drawings, in which.

Figures 1, 2, 3:
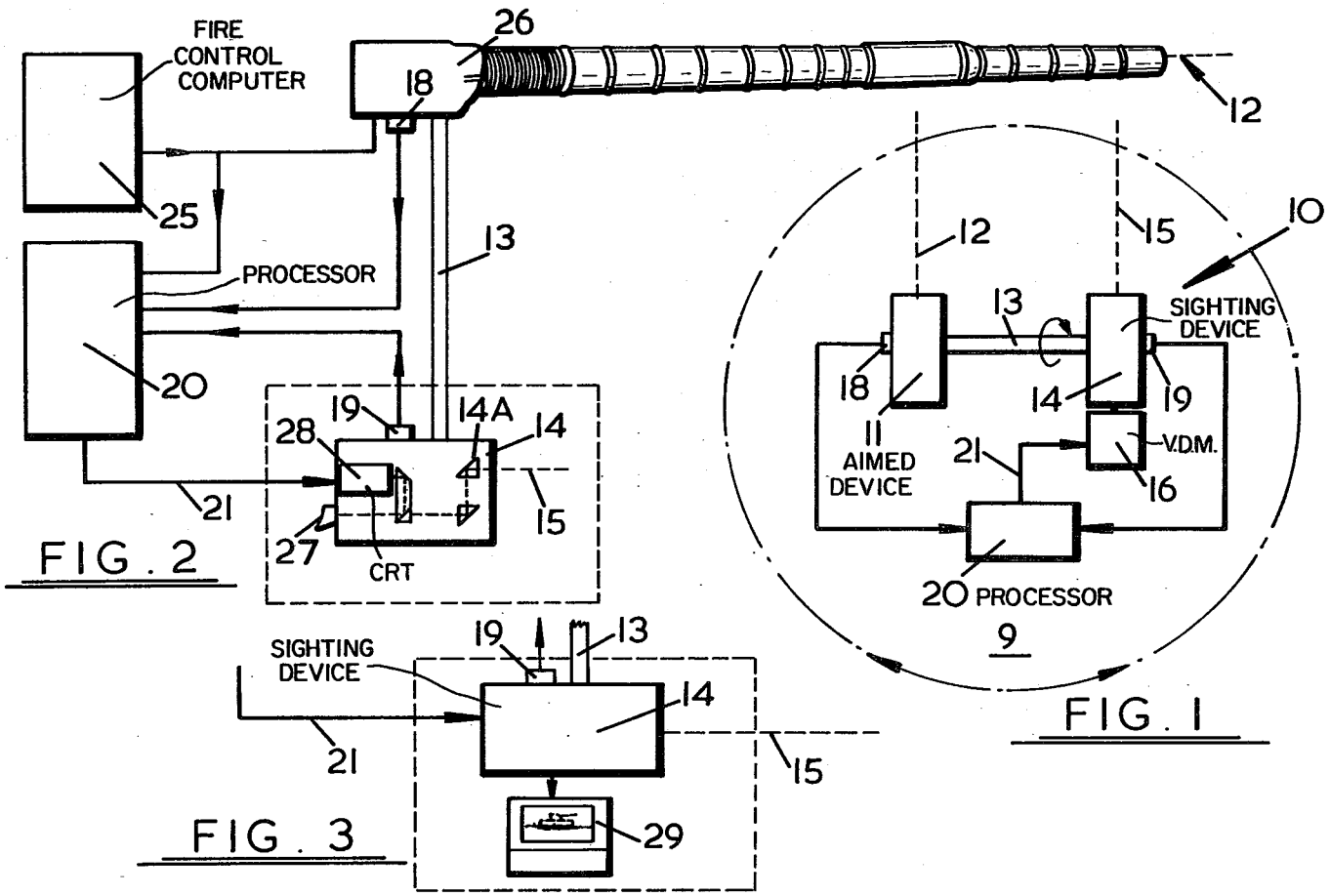
FIG. 1 illustrates the system of the invention schematically.
FIG. 2 shows the system in greater detail applied to a gun fire control system.
FIG. 3 illustrates a modification of a detail in the FIG. 2 arrangement.

As is shown in FIG. 1 the system 10 comprises a trunnionmounted aimed device 11 having a pointing direction 12, interconnected by way of a mechanical tracking link 13, with a trunnion mounted sighting device 14 having a line of sight 15. The trunnions of devices 11 and 14 are mounted rigidly on a common support 9 which is rotatable in the plane of the drawing. The sighting device 14 is rotatable about an axis coincident with the longitudinal axis of the link 13 in order to elevate sight line 15, and by virtue of link 13, the pointing direction 12 is elevated correspondingly. Sighting device 14 is provided with a visual display 16 on which there is formed an image of the field of view containing sight line 15, this display 16 incorporating an electronically-generated indicator mark the position of which is intended to designate the pointing direction 12 of the aimed device 11 so that an operator will witness the field of view and the indicator mark in superimposition and therefore have a correlation between the pointing direction 12 and the field of view of sighting device 14. As is customary the operator has control of the drive mechanisms (not shown) for the device 11 and the support 9 so that the pointing direction of device 11 and the field of view of device 14 can be altered.

By virtue of the fact that link 13 suffers in practise from backlash, bearing friction and inertia elevation of sight line 15 by a predetermined amount to achieve a predetermined elevation does not guarantee that pointing direction 12 will be elevated in like manner. Additionally there may be a very small lack of parallelism in the trunnions of devices 11, 14 the effect of which becomes noticeable as the elevation angle is increased from zero and is in fact a function of the elevation angle. The present invention is directed to providing a practical solution to these problems.

In accordance with the present invention a first sensor 18 is associated with device 11 and a second sensor 19 is associated with device 14 respectively to provide measurements of the elevational position thereof, the output signals of which are fed to an electronic processing unit 20 which provides an output signal on line 21 coupled to the visual display 16 to deflect the electronically-generated aiming mark therein so that it accurately designates the pointing direction 12 and compensates for the previously mentioned error induced by the link 13 and the trunnions.

The sensors 18, 19 may conveniently be in the form of shaft encoders or synchros, either absolute or incremental, and provide accurate information on the relative elevation of direction 12 with respect to sight line 15 each with respect a datum which, for example, is established by a daily set-up procedure.

The processing unit 20 incorporates a comparator to provide the difference between the signals of sensors 18, 19 and thereby provide a first correction signal for compensating in the elevation axis against errors induced by the link 13, and additionally unit 20 provides a second correction signal for the traverse axis which is a function of the trunnion parallelism error (which is predetermined) and the absolute elevation of sight line 15, it being these two correction signals which form the output signal on line 21.

It will be evident that because the aiming mark is electronically generated and displaced by electrical signals such displacement is undertaken without delays so that the compensation system is virtually free of inertia.

The invention may be applied to gun fire control systems in armoured fighting vehicles as schematically shown in FIG. 2. Fire control systems generally utilise a Laser Rangefinder (not shown but which is aligned to the sighting device 14), to measure the range to a target. To aim the laser rangefinder using the sighting device 14, a laser aiming mark is injected, referenced to the axis of the gun bore 12 and from the measured range, the fire control computer 25 calculates the elevation which is required by the gun 26 to hit the target. A ballistic aiming mark is then injected onto the image scene below the image gun bore axis mark by the calculated elevation. The gun 26 and sight 14 are then elevated until the ballistic aiming mark coincides with the target. The sighting device 14 or its top mirror 14A is mounted on pivots parallel to the gun pivots and is linked in elevation to the gun 26 by the tracking link 13.

Present methods of linking the aimed device 26 and the sighting device 14 can be by rigid mechanical links or by servos. In both cases the accuracy of the reticle position in the image plane is dependent on these linking systems 13 which suffer from deadband, non-linearity etc. and it is to overcome this problem that the invention is utilised.

As will be evident from FIG. 2 the visual display 16 in this case comprises an eyepiece 27 and the aiming marks are injected by means of a CRT 28.

FIG. 3 shows a modification of a detail in the FIG. 2 arrangement wherein sighting device 14 is in the form of a thermal imager with an associated visual display 29 of the scanned-raster type. Display 29 need not be part of device 14 but may be remote.

Figure 4:
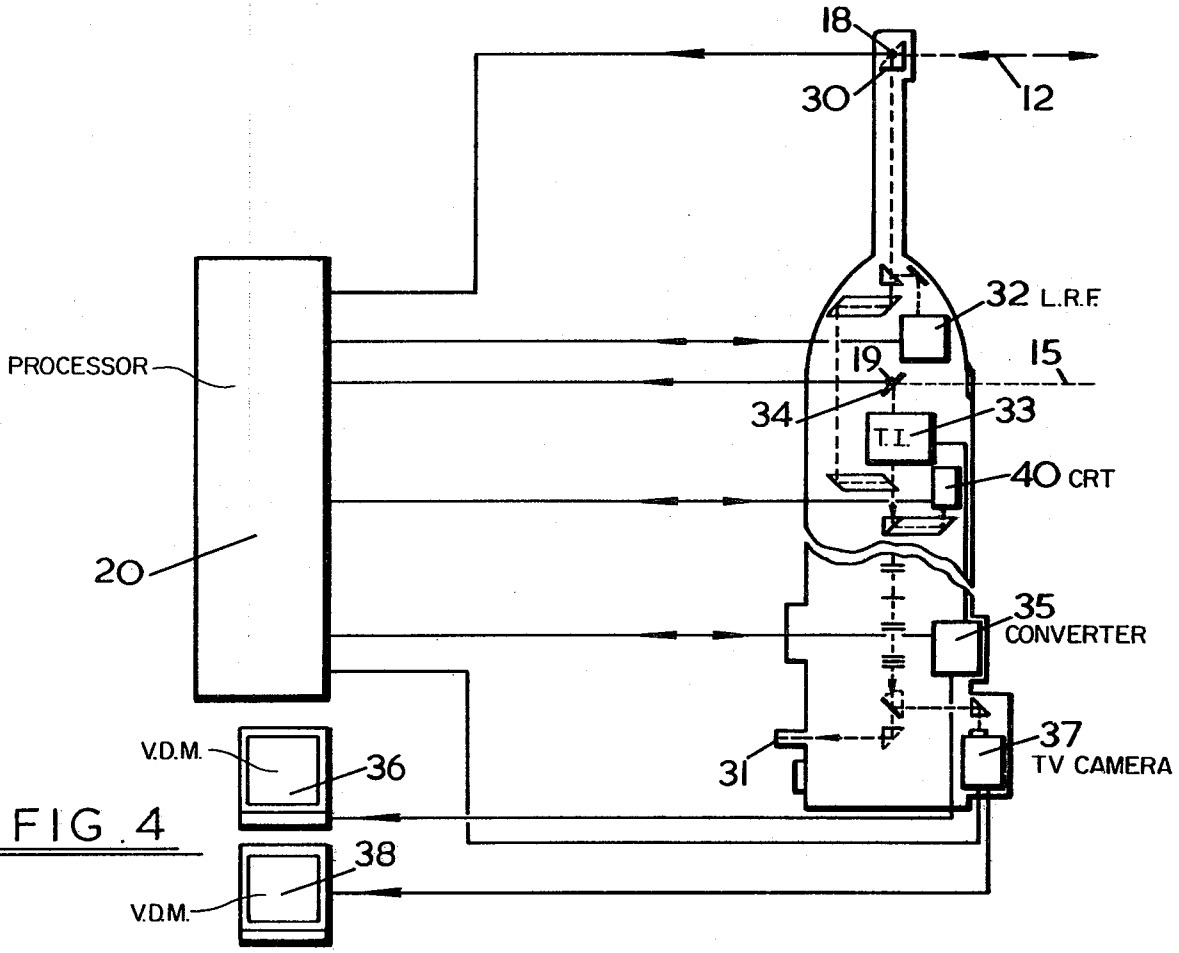
FIG. 4 shows the system applied to a submarine periscope.

The invention may also be applied to submarine periscope systems as schematically shown in FIG. 4.

In this case the aimed device 11 comprises top mirror 30 which is optically coupled either to visual eyepiece 31 at the foot of the periscope or to a laser 32 forming part of a rangefinder. The sighting device 14 comprises a thermal imager 33 with associated top mirror 34 the visual display of which is provided by a scan converter 35 on a monitor 36. The aiming or indicator mark is injected into scan converter 35 by electronic processing unit 20 which forms part of a larger electronic processor performing a range finding function. Alternatively the visual scene from mirror 30 may be fed to a TV camera 37 providing a visual display on a monitor 38 with the unit 20 injecting the indicator mark directly into camera 37. As a further alternative the image fed to eyepiece 31 or to camera 37 may be the combination of that provided by top mirror 30 and by a CRT 40 which is controlled by unit 20 to inject the indicator mark. Instead of a thermal imager an image intensifier could be used in combination with CRT 40.

CRT 40 is controlled by its X and Y coils and the pattern produced thereby on the CRT face is optically superimposed on the visual field from top mirror 30 whereas converter 35 and TV camera 37 are controlled to provide the aiming mark by generating video bright-up pulses synchronised on the raster scan, the composite video signal being used to generate the output image.

The sighting and aiming devices in this case may have differences or errors in elevation alignment due either to errors in linkages or servos, or due to one device having a line of sight stabilised against vehicle motion, and the other following vehicle motion and it is to overcome this problem that the invention is utilised.

Calibration procedures may be included in the system of the present invention to adjust the aiming or indicator mark position to take account of any inherent distortions of the image field on the field of view. This is simply achieved by providing processing unit 20 with data correlating elevation over the full range with the indicator mark position signal.

What is claimed is:

1. A system comprising a trunnion-mounted aimed device having a pointing direction, a trunnion-mounted sighting device having a line of sight, a visual display providing an image of the field of view containing said line of sight, drive means connected to said aimed device for altering the elevation of said pointing direction, a tracking link interconnecting the aimed device and the sighting device to provide approximate correspondence in elevation of said pointing direction of said line of sight, a first elevation sensor associated with the aimed device for providing a first sensor measurement accurately measuring the elevation of the aimed device with respect to a datum, a second elevation sensor associated with the sighting device for providing a second sensor measurement accurately measuring the elevation of the sighting device with respect to said datum, wherein said visual display comprises electronic means for generating a deflectable indicator mark designating the pointing direction and an electronic processor is provided operable according to the sensor measurements to deflect the electronically generated indicator mark on said visual display accurately to designate the pointing direction of the aimed device so as to compensate in the elevation axis for backlash and inertia of said tracking link and in the traverse axis for lack of parallelism of the trunnions.

2. A system as claimed in claim 1, wherein said visual display comprises a CRT on which said indicator mark is generated and said electronic processor is connected to the X and Y drive circuits of said CRT to deflect the generated indicator mark according to the sensor measurements, and optical image combination means arranged to combine the CRT display with the field of view image.

3. A system as claimed in claim 1, wherein said visual display comprises a TV camera arranged to record the field of view and the electronic processor is arranged to provide the indicator mark by generating video bright-up pulses synchronised with the raster scan of the TV camera, the composite video signal being connected to a raster-scan monitor for display thereon.

4. A system as claimed in claim 1, wherein said sighting device comprises a thermal imager or image intensifier.

5. A system as claimed in claim 1, wherein one of said trunnion-mounted devices is stabilised in elevation and the other of said devices is not so stabilised.

* * * * *